US010646740B2

(12) United States Patent
Lee

(10) Patent No.: US 10,646,740 B2
(45) Date of Patent: May 12, 2020

(54) ANGLE-ADJUSTABLE AND SWINGABLE SMITH MACHINE

(71) Applicant: Byung Don Lee, Seoul (KR)

(72) Inventor: Byung Don Lee, Seoul (KR)

( * ) Notice: Subject to any disclaimer, the term of this patent is extended or adjusted under 35 U.S.C. 154(b) by 114 days.

(21) Appl. No.: 15/774,594

(22) PCT Filed: Nov. 10, 2016

(86) PCT No.: PCT/KR2016/012903
§ 371 (c)(1),
(2) Date: May 9, 2018

(87) PCT Pub. No.: WO2017/082644
PCT Pub. Date: May 18, 2017

(65) Prior Publication Data

US 2018/0318635 A1 Nov. 8, 2018

(30) Foreign Application Priority Data

Nov. 13, 2015 (KR) ..... 10-2015-0159887
Nov. 10, 2016 (KR) ..... 10-2016-0149279

(51) Int. Cl.
*A63B 21/062* (2006.01)
*A63B 21/078* (2006.01)
(Continued)

(52) U.S. Cl.
CPC ..... *A63B 21/0626* (2015.10); *A63B 21/0622* (2015.10); *A63B 21/075* (2013.01);
(Continued)

(58) Field of Classification Search
CPC ..... A63B 21/0626; A63B 21/078; A63B 24/0087; A63B 21/0622; A63B 21/0724;
(Continued)

(56) References Cited

U.S. PATENT DOCUMENTS 3,359,802 A * 12/1967 Sollenberger .... A63B 23/03525 482/112
3,451,271 A * 6/1969 Knoblauch ..... A63B 21/0083 482/113
(Continued)

FOREIGN PATENT DOCUMENTS

CA 1288790 C 9/1991
CA 2381949 A1 3/2001
(Continued)

OTHER PUBLICATIONS

International Search Report for PCT/KR2016/012903 dated Mar. 15, 2017 from Korean Intellectual Property Office.
Indian Examination Report dated Nov. 28, 2019.

*Primary Examiner* — Garrett K Atkinson
(74) *Attorney, Agent, or Firm* — Revolution IP, PLLC

(57) ABSTRACT

An angle-adjustable and swingable Smith machine includes: a frame part for forming an exercise space; a swing part which is disposed in the exercise space and is connected to the frame part; a guide part which is integrally coupled to the swing part and performs a swing operation together with the swing part; a rail part, which is installed on the upper end of the frame part, for guiding the movement of the swing part, and setting or fixing the angle of the swing part; an angle adjustment part for adjusting the angle of the swing part by interworking with the rail part; and a barbell part which is coupled to the guide part so as to ascend and descend.

14 Claims, 16 Drawing Sheets

(51) Int. Cl.

| | |
|---|---|
| ***A63B 24/00*** | (2006.01) |
| ***A63B 21/072*** | (2006.01) |
| ***A63B 21/075*** | (2006.01) |
| ***A63B 21/00*** | (2006.01) |
| ***A63B 71/06*** | (2006.01) |

(52) U.S. Cl.
CPC ..... *A63B 21/078* (2013.01); *A63B 21/0724* (2013.01); *A63B 21/156* (2013.01); *A63B 24/0087* (2013.01); *A63B 21/0783* (2015.10); *A63B 21/4029* (2015.10); *A63B 71/06* (2013.01); *A63B 2220/20* (2013.01); *A63B 2220/24* (2013.01)

(58) Field of Classification Search
CPC ..... A63B 21/075; A63B 21/156; A63B 71/06; A63B 2220/24; A63B 2220/20; A63B 21/0783; A63B 21/4029; A63B 21/0004; A63B 21/072; A63B 21/151
See application file for complete search history.

(56) References Cited

U.S. PATENT DOCUMENTS

| | | | | | |
|---|---|---|---|---|---|
| 3,606,318 | A * | 9/1971 | Gilstrap | A63B 21/0083 | 482/112 |
| 4,286,782 | A * | 9/1981 | Fuhrhop | A63B 21/078 | 482/103 |
| 4,784,384 | A * | 11/1988 | Deola | A63B 21/063 | 482/138 |
| 4,856,773 | A * | 8/1989 | Deola | A63B 21/063 | 482/102 |
| 5,018,725 | A * | 5/1991 | Cook | A63B 21/154 | 482/103 |
| 5,044,629 | A * | 9/1991 | Ryan | A63B 21/154 | 482/101 |
| 5,135,453 | A * | 8/1992 | Sollenberger | A63B 21/155 | 482/101 |
| 5,215,510 | A * | 6/1993 | Baran | A63B 21/078 | 482/104 |
| 6,245,000 | B1 * | 6/2001 | Saakian | A61H 15/00 | 482/142 |
| 6,379,287 | B1 * | 4/2002 | Slawinski | A63B 21/00181 | 482/104 |
| 6,450,927 | B1 * | 9/2002 | Ellis | A63B 21/078 | 482/104 |
| 6,811,521 | B1 * | 11/2004 | Musso | A63B 21/0626 | 482/104 |
| 7,488,277 | B1 * | 2/2009 | Knapp | A63B 21/078 | 482/104 |
| 7,591,770 | B2 * | 9/2009 | Stewart | A63B 23/12 | 482/100 |
| 8,328,698 | B1 * | 12/2012 | Webber | A63B 21/078 | 482/104 |
| 8,740,760 | B2 * | 6/2014 | York | A63B 21/078 | 482/104 |
| 8,834,329 | B2 * | 9/2014 | Kelly | A63B 21/0724 | 482/104 |
| 10,245,461 | B2 * | 4/2019 | Bruni | A63B 21/062 | |
| 2002/0091043 | A1 * | 7/2002 | Rexach | A63B 21/156 | 482/98 |
| 2005/0054495 | A1 * | 3/2005 | Stewart | A63B 23/12 | 482/100 |
| 2009/0143203 | A1 * | 6/2009 | Knapp | A63B 21/078 | 482/104 |
| 2013/0190143 | A1 | 7/2013 | Greenhill et al. | | |
| 2014/0128229 | A1 * | 5/2014 | York | A63B 21/078 | 482/104 |

FOREIGN PATENT DOCUMENTS

| | | | |
|---|---|---|---|
| JP | 2004-201943 | A | 7/2004 |
| JP | 2004-520897 | A | 7/2004 |
| KR | 10-1315514 | B1 | 10/2013 |
| KR | 10-1518197 | B1 | 5/2015 |

* cited by examiner

【Figure 1】
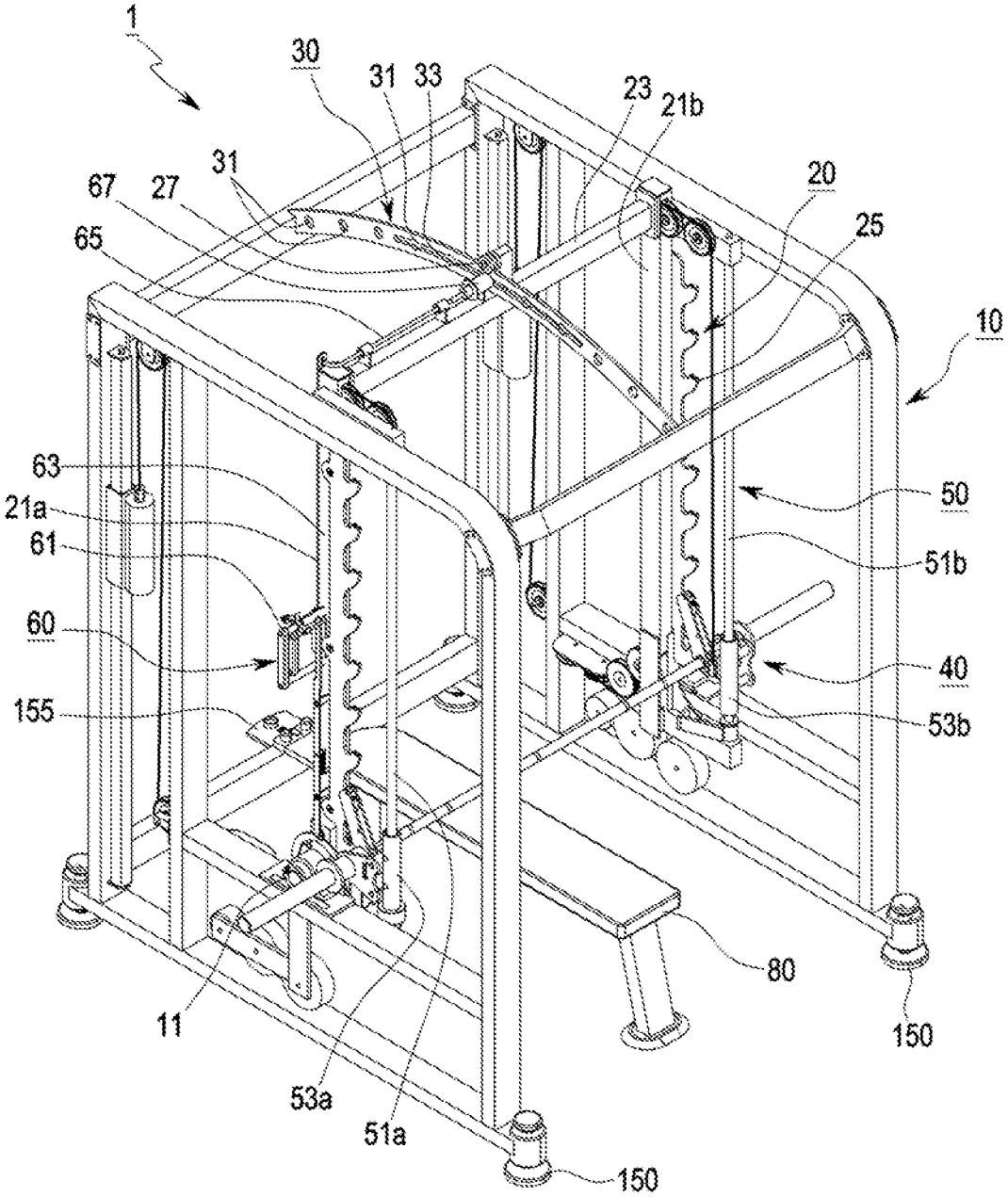

【Figure 2】
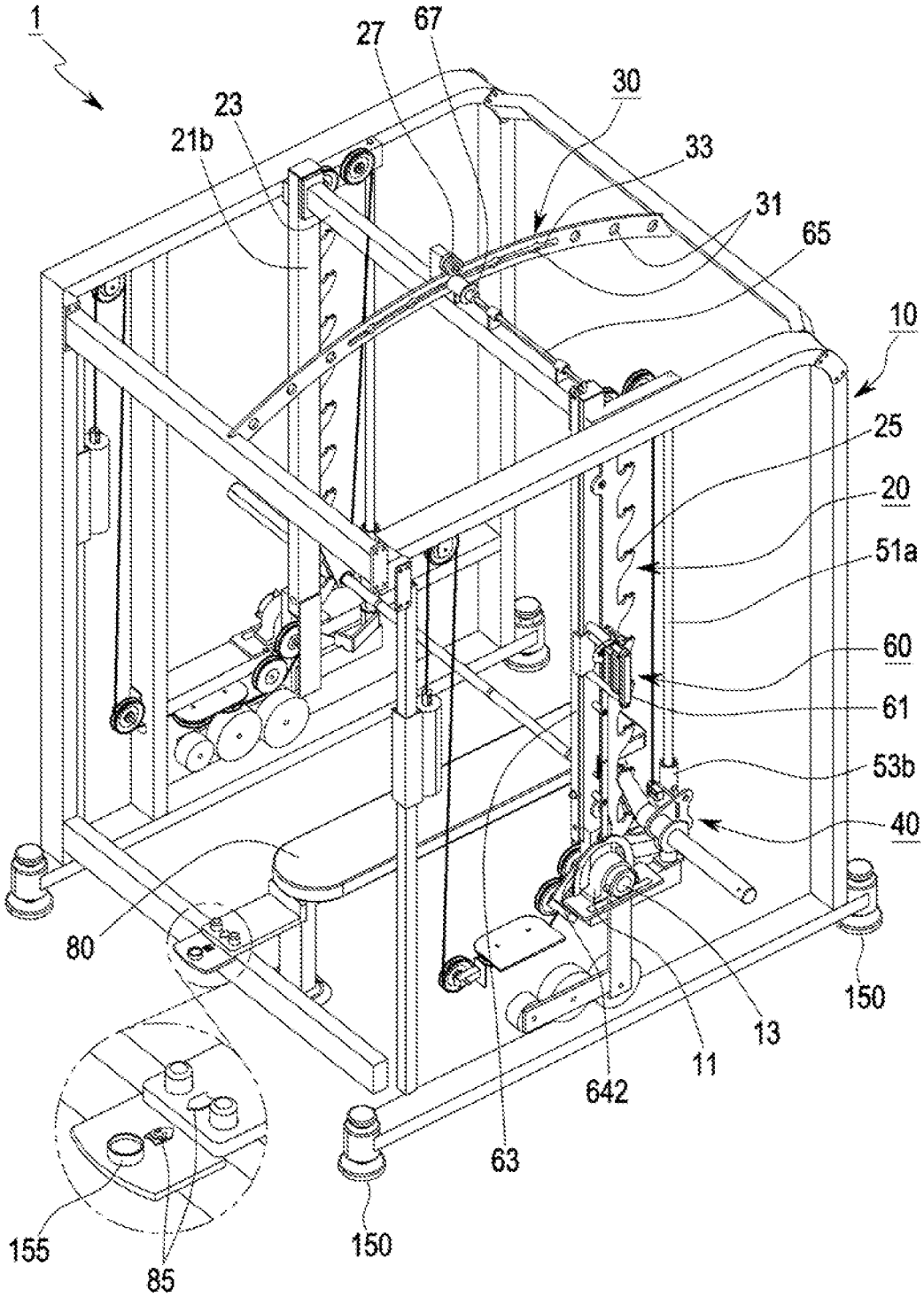

【Figure 3】
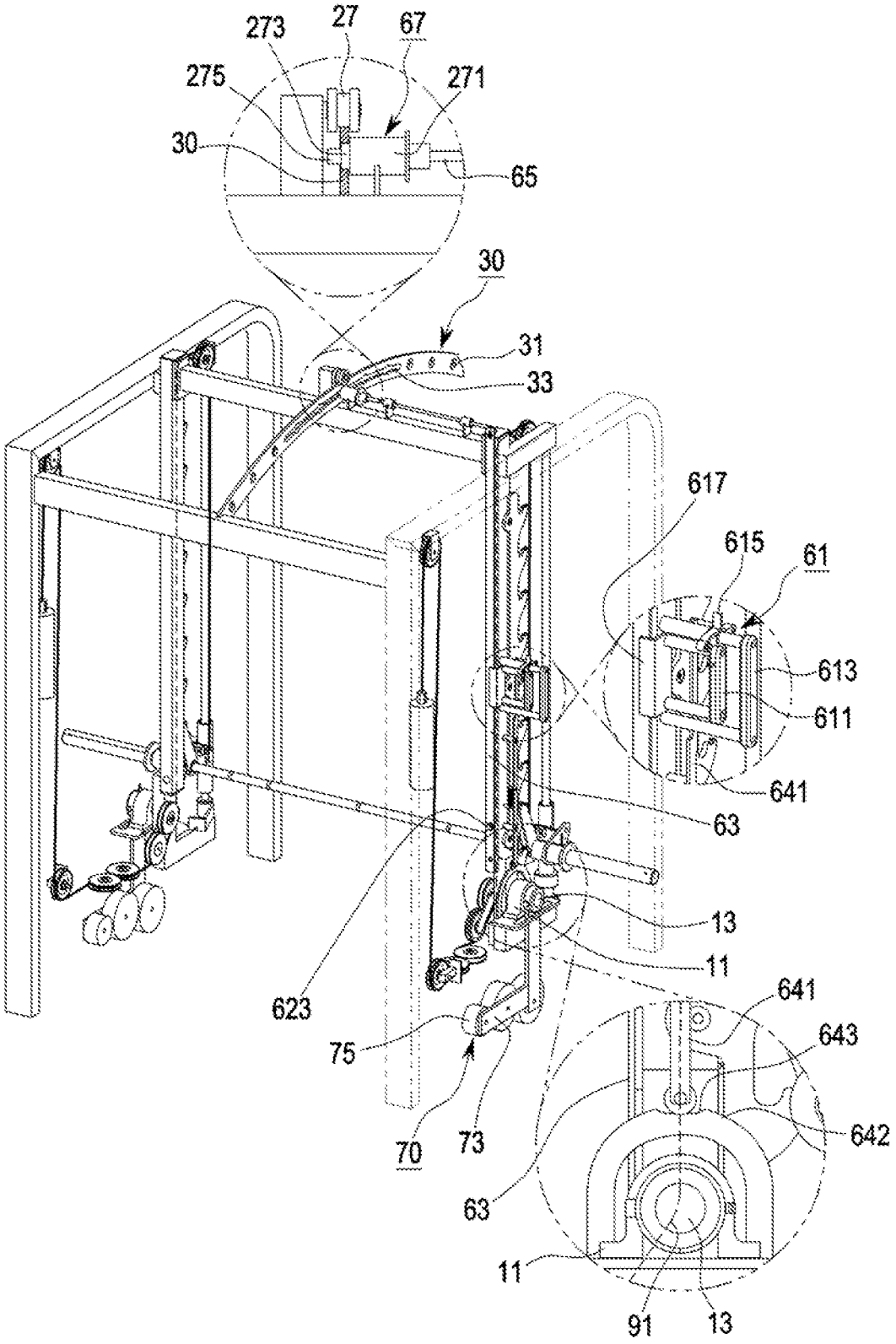

【Figure 4】
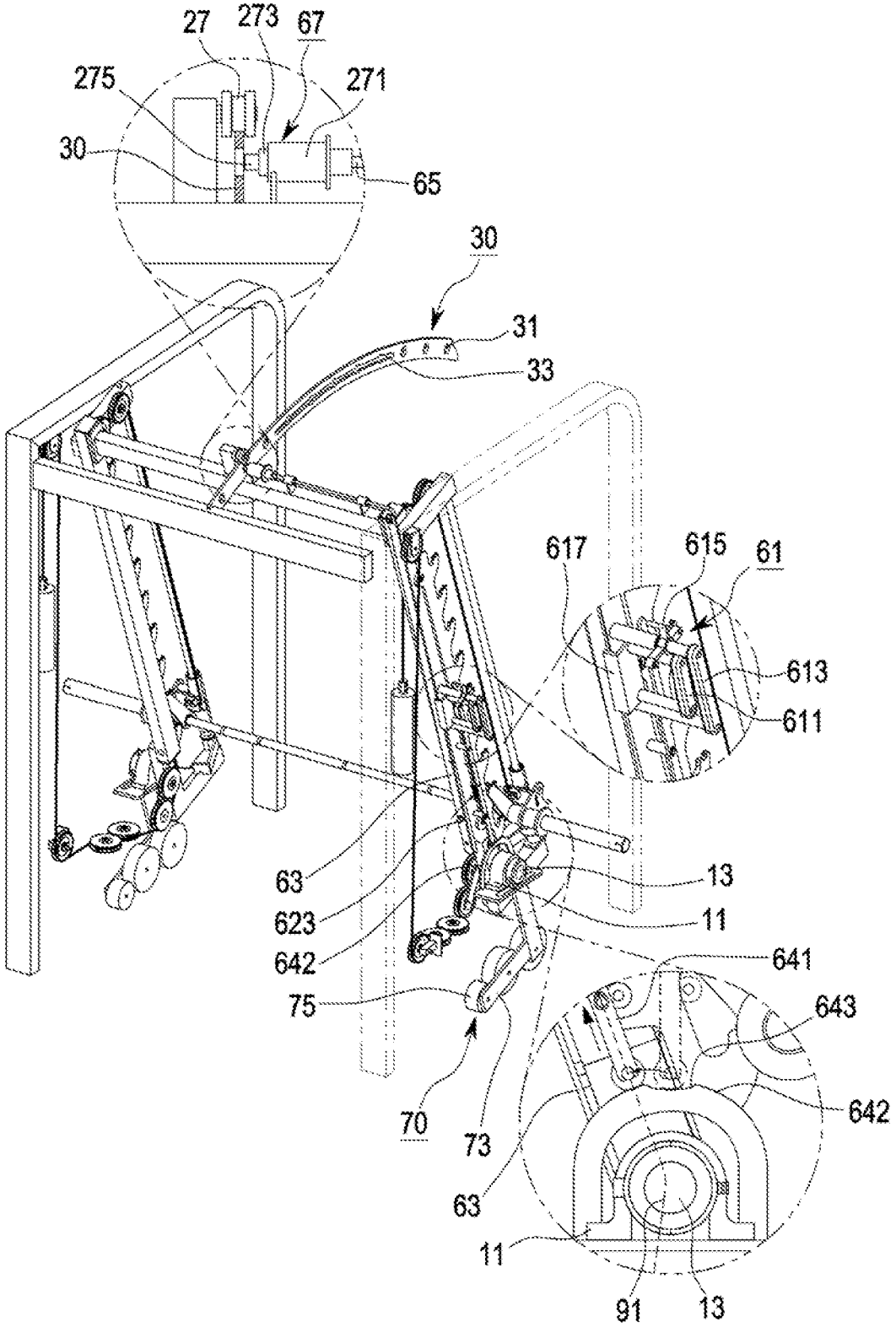

【Figure 5】
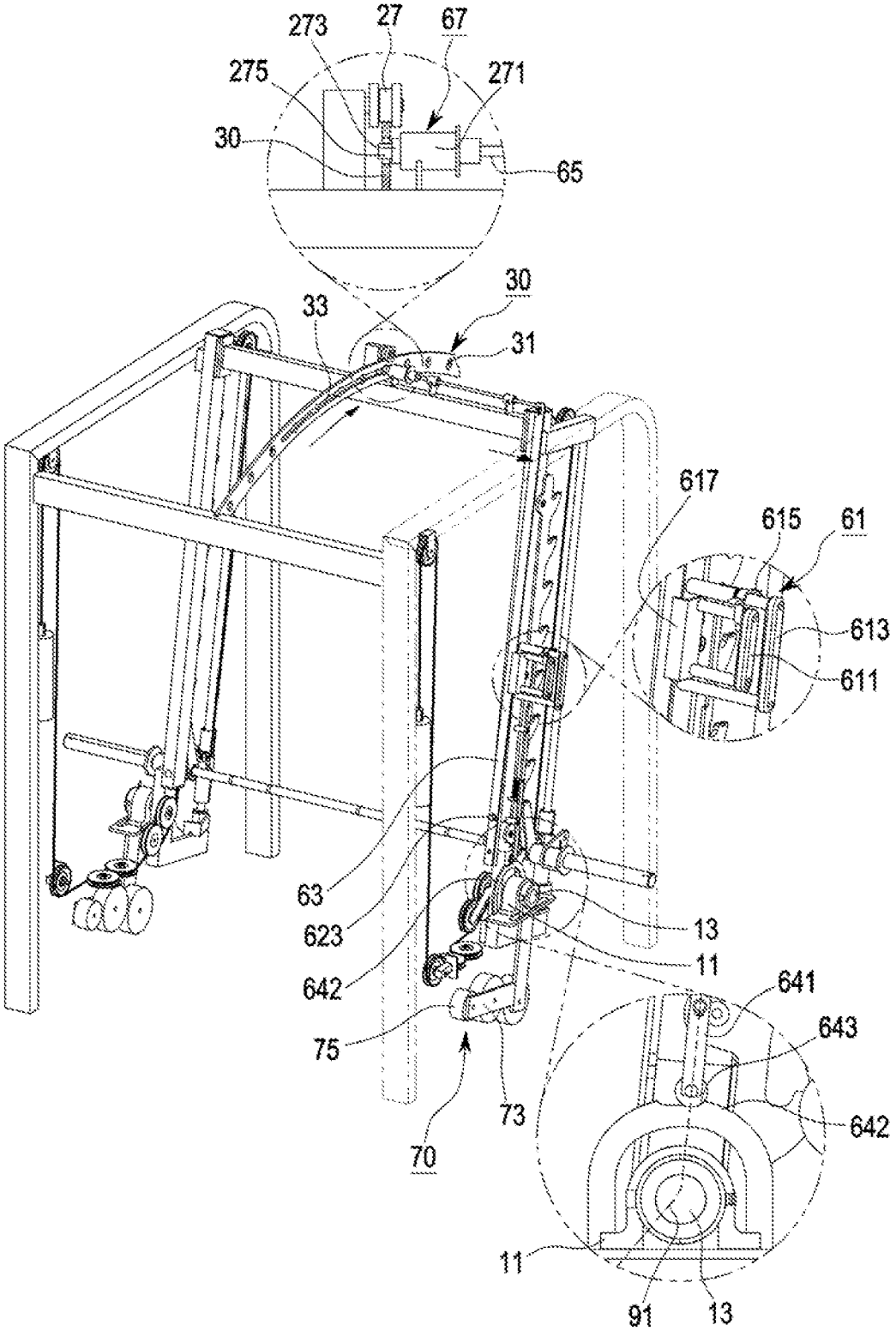

【Figure 6】
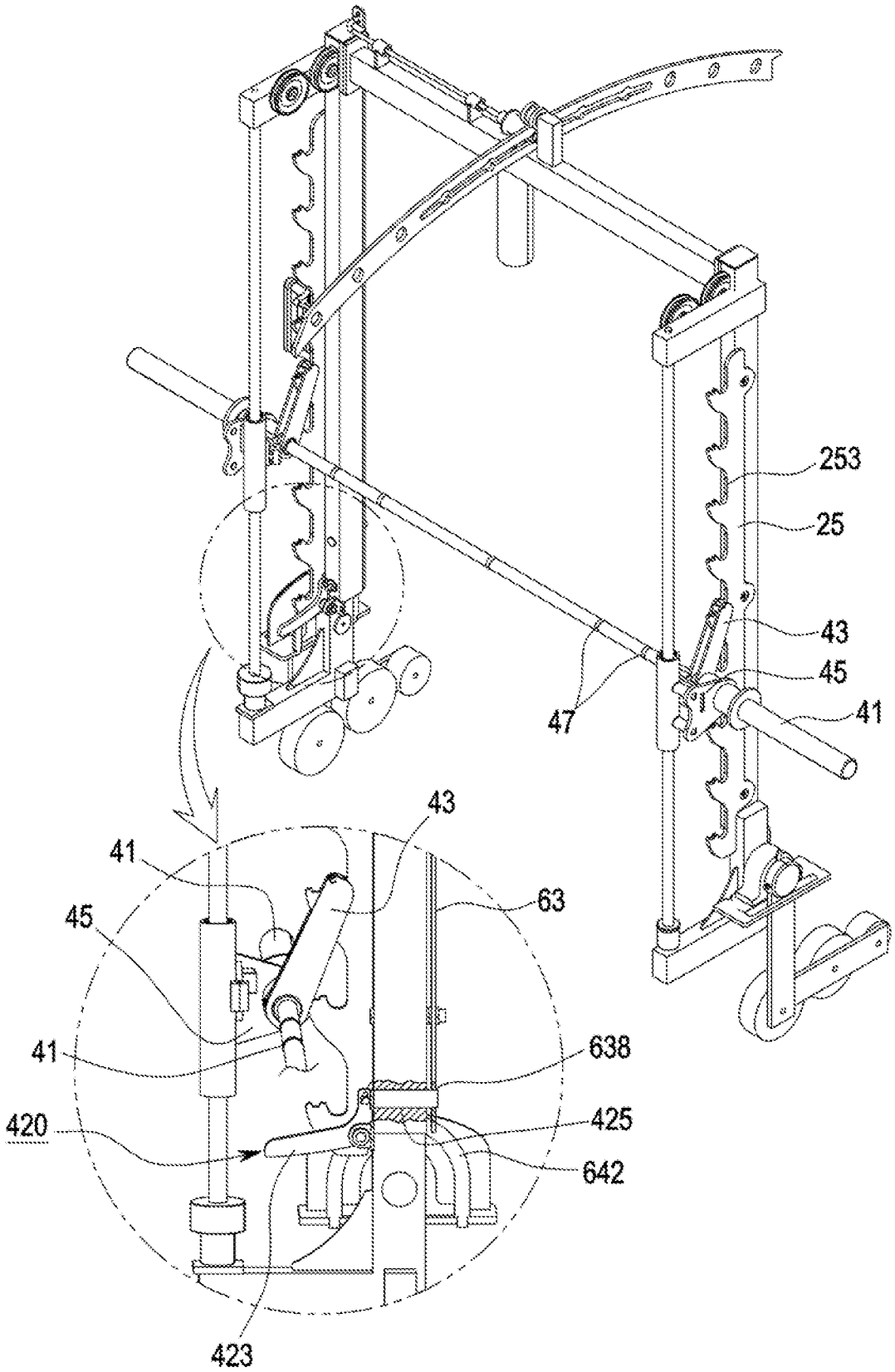

【Figure 7】
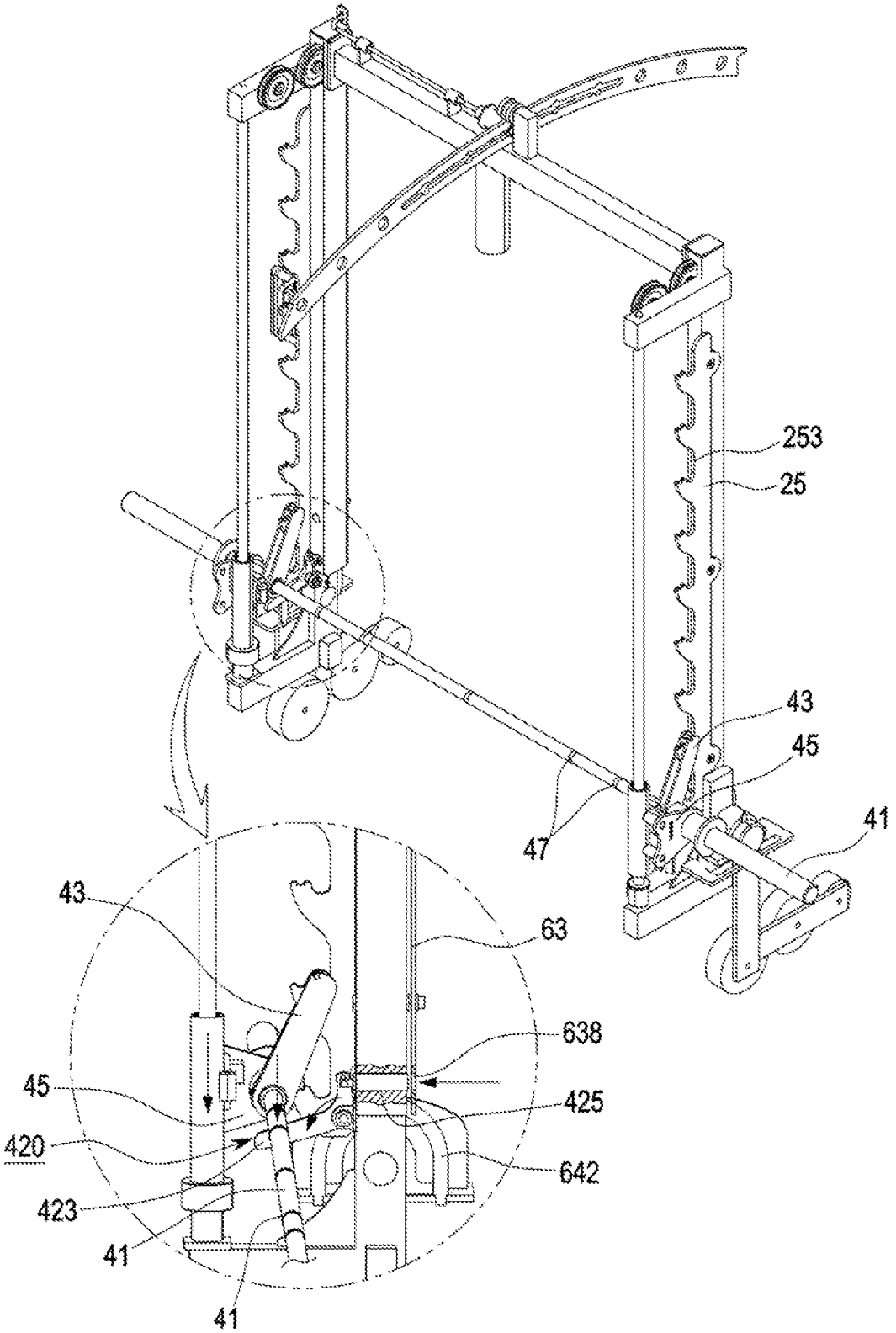

【Figure 8】
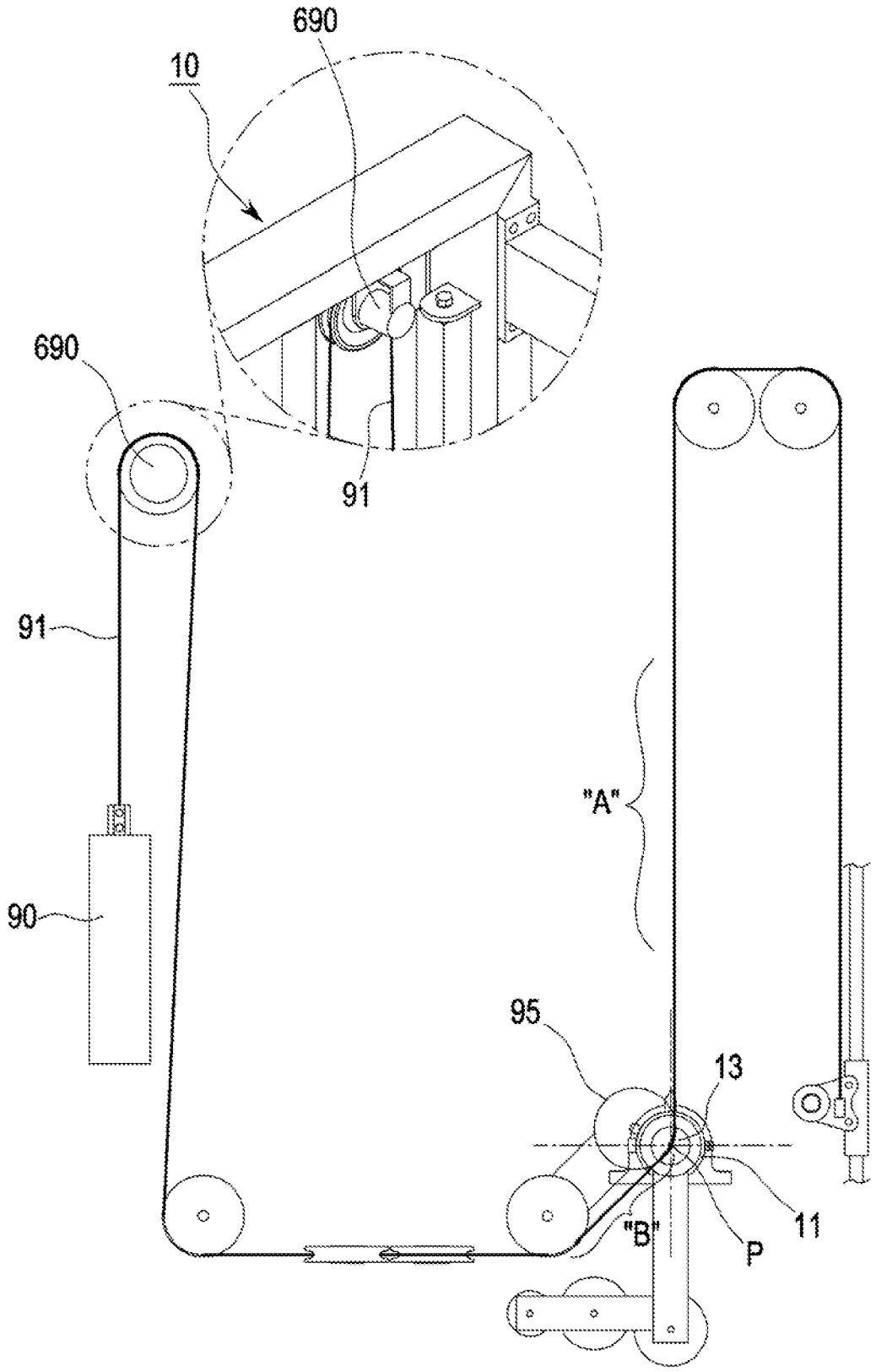

【Figure 9】
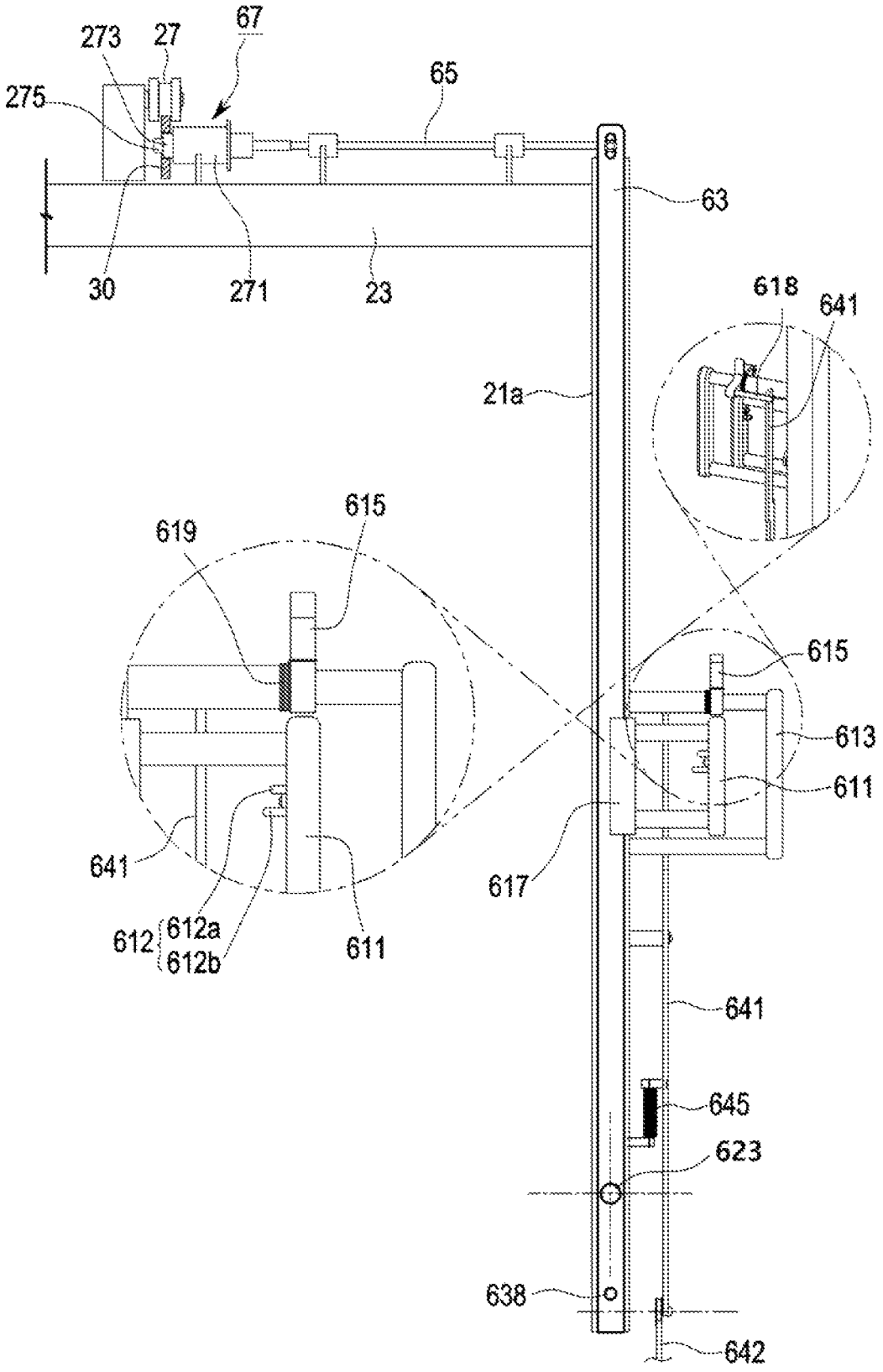

【Figure 10】
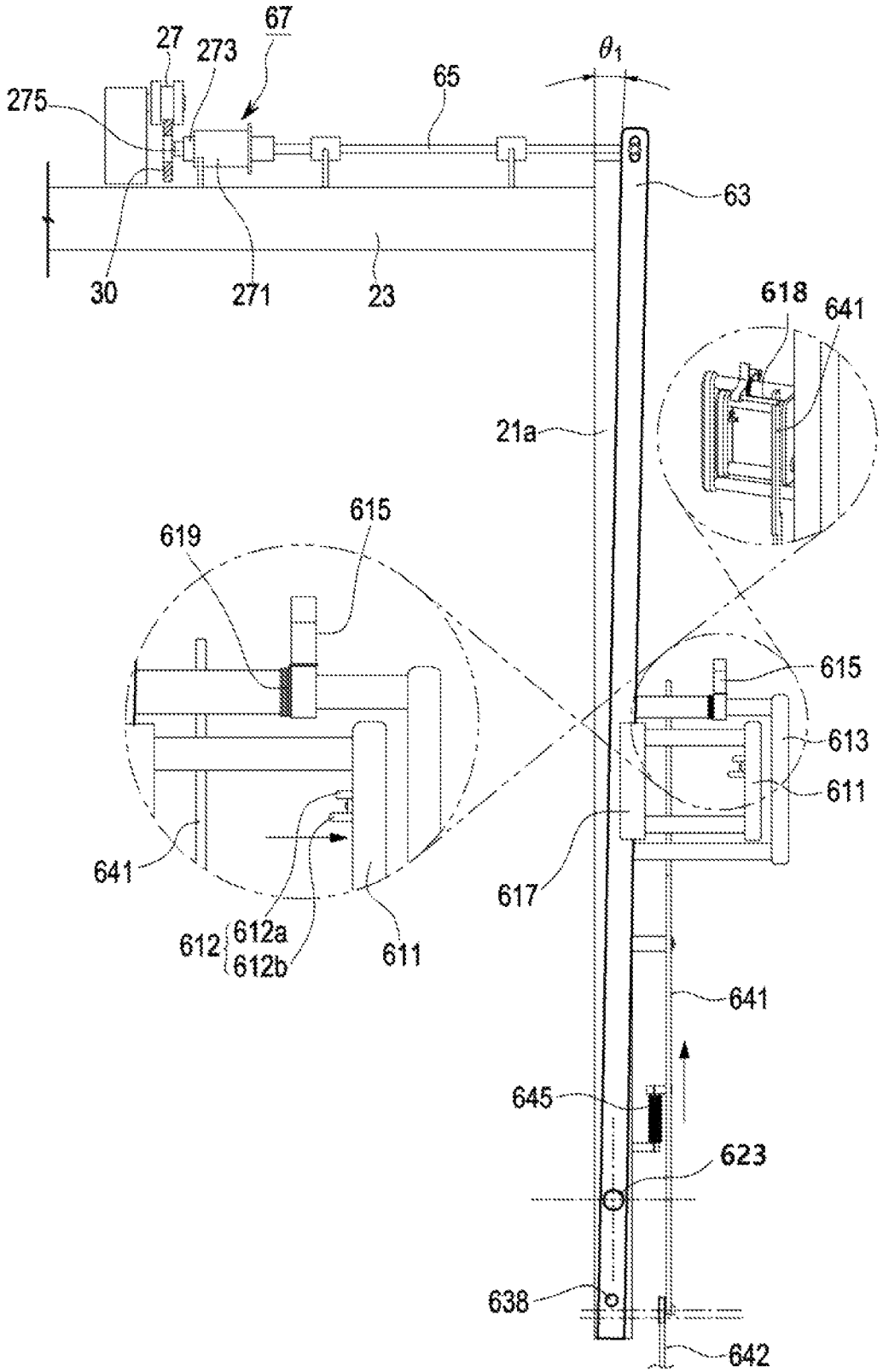

【Figure 11】
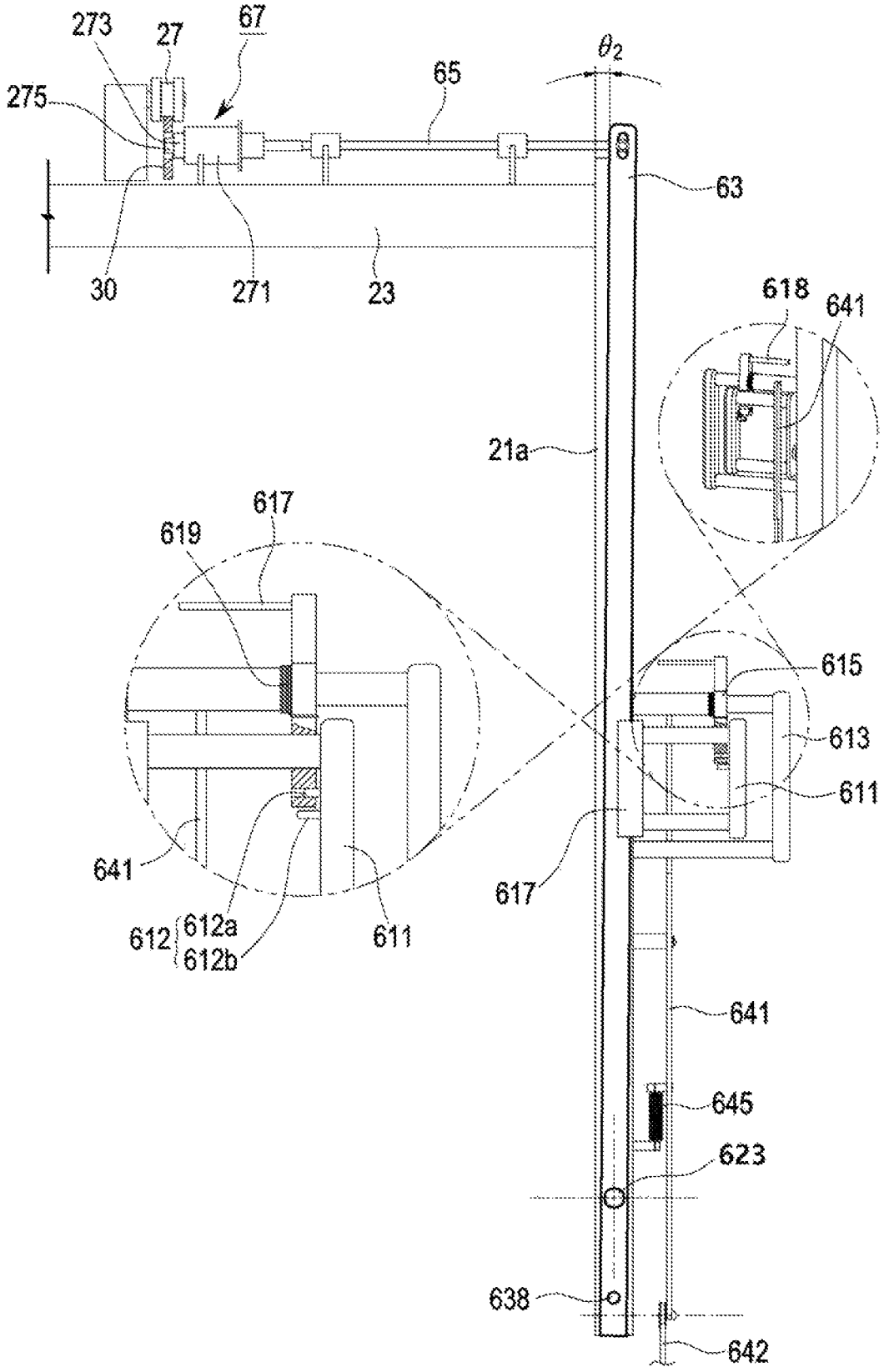

【Figure 12】
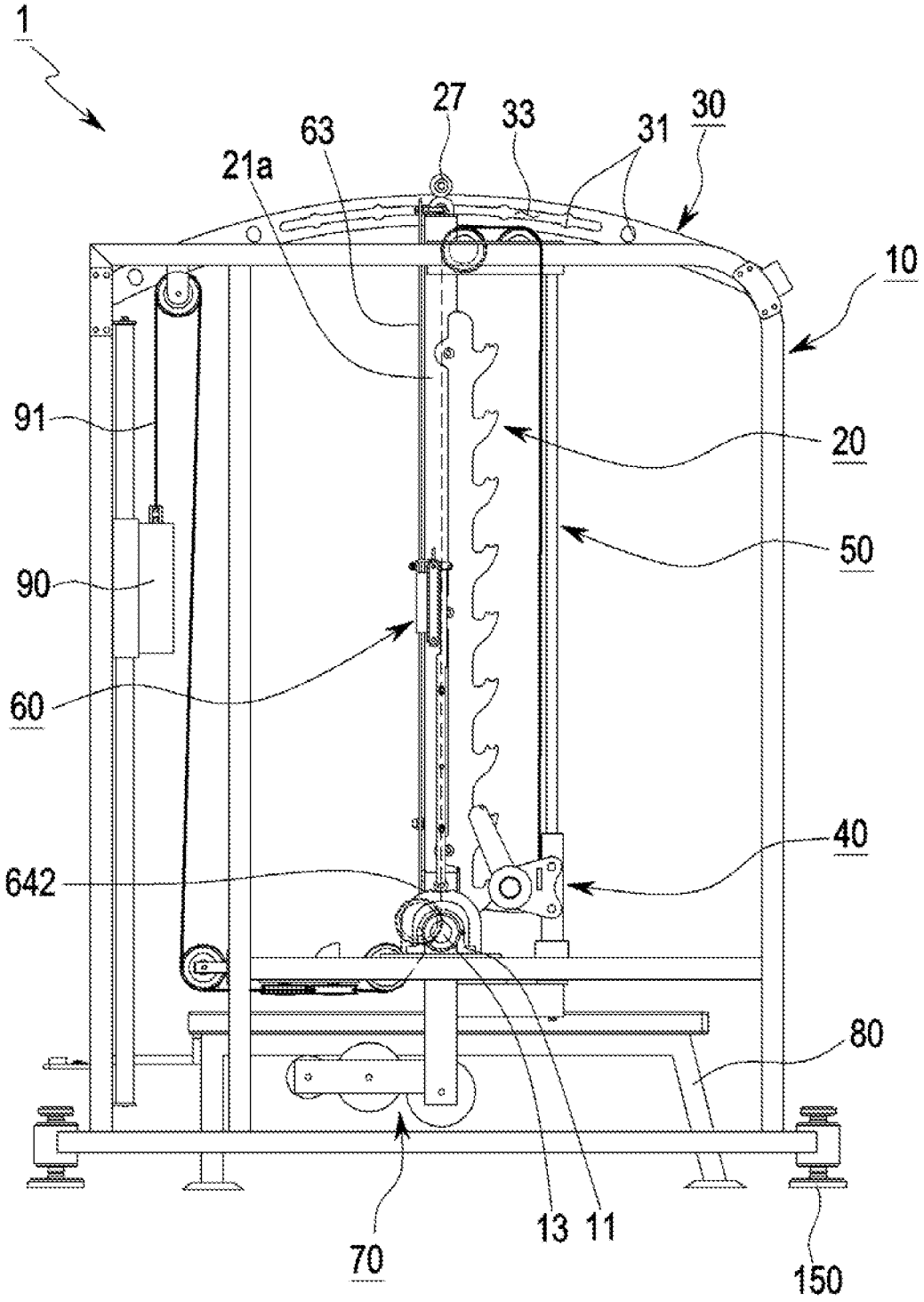

【Figure 13】
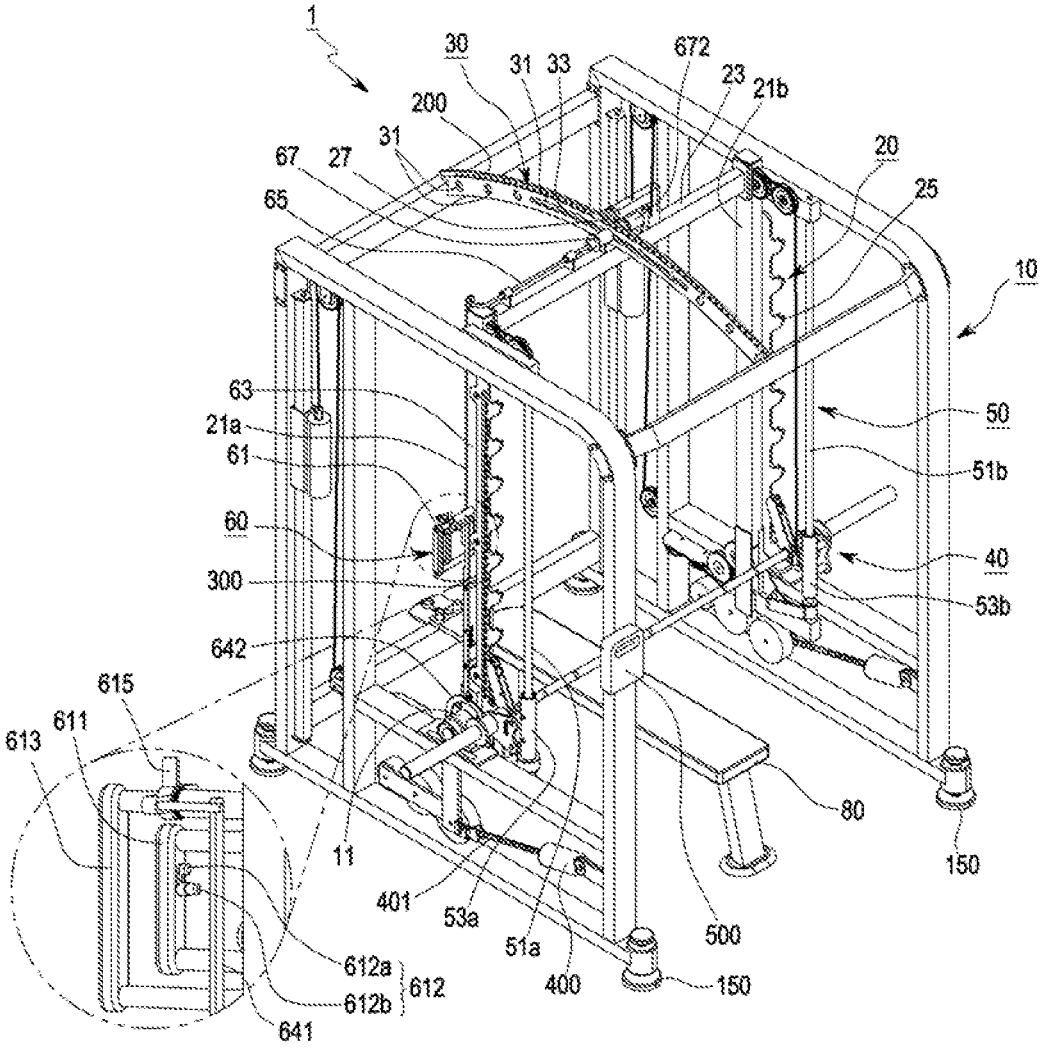

【Figure 14】
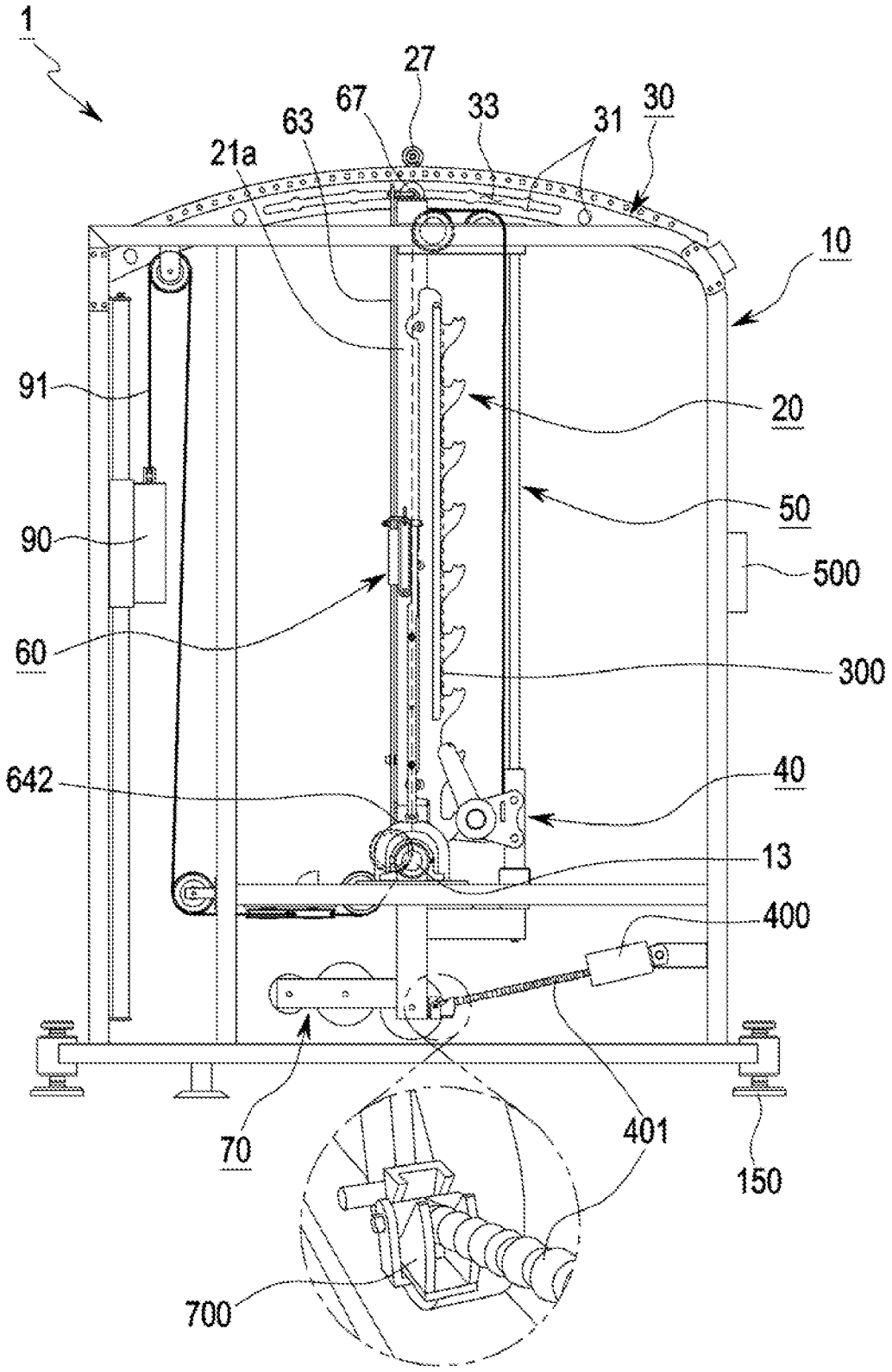

【Figure 15】
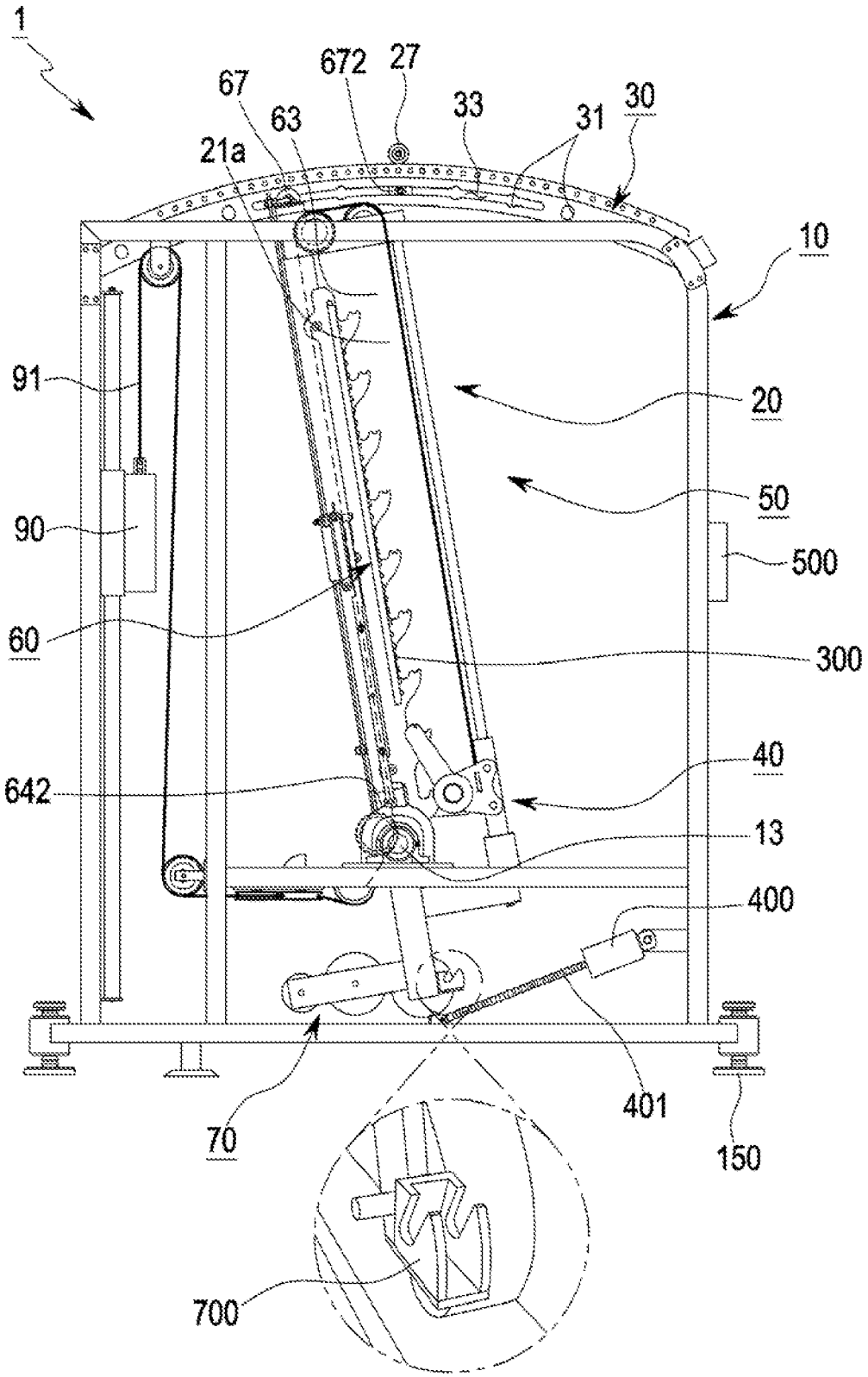

【Figure 16】
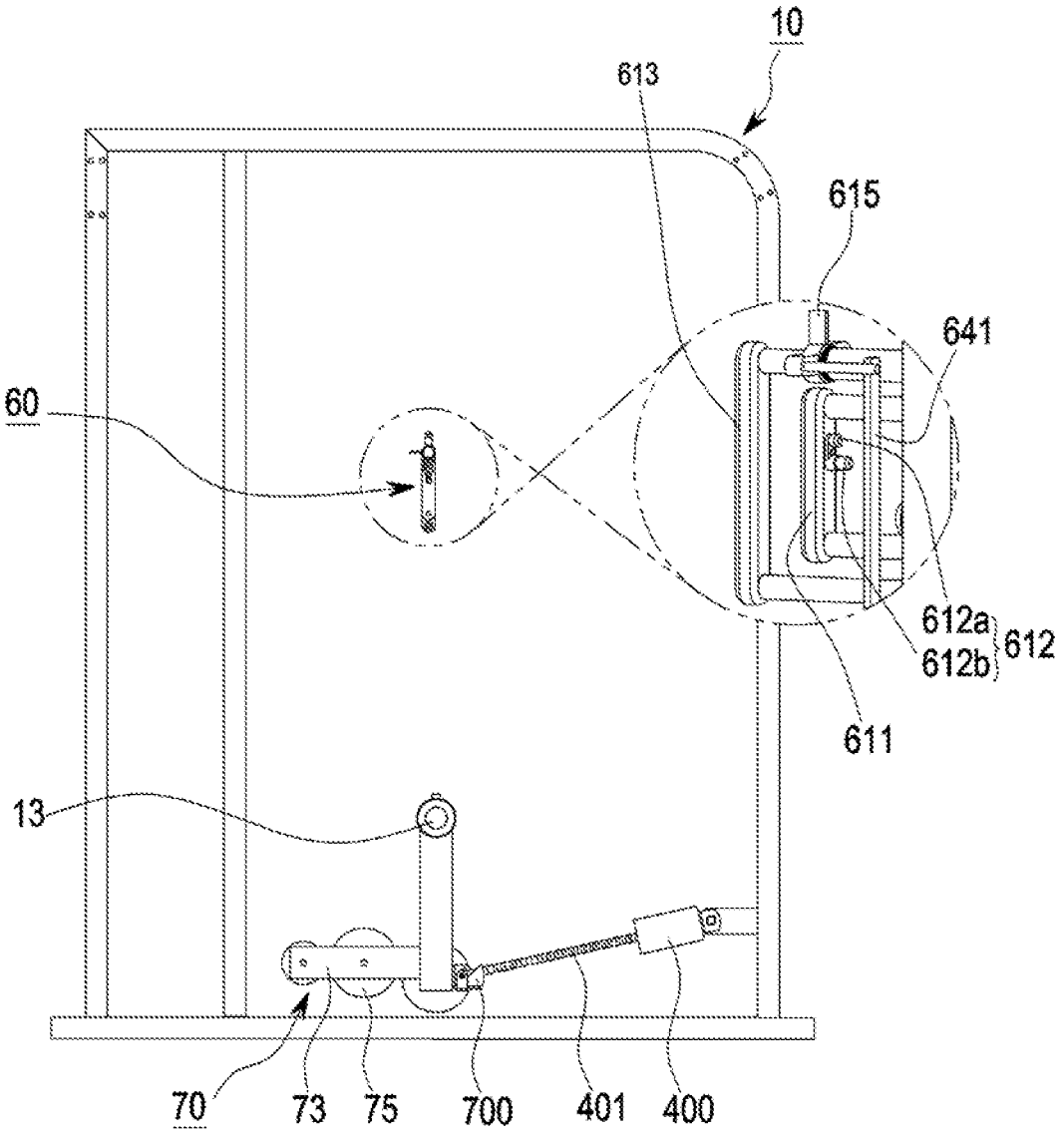

ANGLE-ADJUSTABLE AND SWINGABLE SMITH MACHINE

TECHNICAL FIELD

The present invention relates to an angle-adjustable and swingable Smith machine that is manual or electrical. Additionally, the present invention relates to a training machine having a structure and an exercise effect similar to those of the Smith machine.

BACKGROUND ART

Exercise apparatuses are divided into exercise apparatuses for upper body training and exercise apparatuses for lower body training. A weight, capable of being adjusted according to a user, is provided in such exercise apparatuses for the user to perform muscular exercise of an upper body or a lower body.

For example, a lower body exercise apparatus is an exercise apparatus for strengthening calf muscles and thigh muscles, and an upper body exercise apparatus is an exercise apparatus for strengthening back muscles and shoulder muscles of the user or arm muscles of the user.

Of the above-described exercise apparatuses, there is an exercise apparatus referred to as a so-called Smith machine, which includes two supporting frames located on both sides that correspond to each other, a barbell bar held between the two supporting frames, and disc type weights which fit onto ends of the barbell bar such that the user inserts disciform weights, which weigh as much as the user chooses, onto the ends of the barbell bar and then proceeds to exercise.

The supporting frames function merely as a guide to allow the barbell bar to move upward or downward.

Upon exercise using the barbell, depending on angles at which the barbell is lifted, particular areas of corresponding muscles may be stimulated. Here, since a conventional Smith machine is used while being fixed at a single angle, there is a limitation in stimulating muscles.

Also, the conventional Smith machine does not have a function of leveling according to a condition of a bottom surface on which the Smith machine is disposed. Accordingly, the barbell may not be leveled such that an exercise leaning phenomenon, in which a force is further used to be biased toward a left side or a right side based on a philtrum of the user, occurs during exercise. In this case, an error in which muscles of any one of the left side or the right side are more developed may occur and a problem of a disease such as scoliosis may be caused.

Also, in the conventional Smith machine, it is necessary to hold the barbell at the same interval for a left side and a right side based on the center of the bar. However, after use for a long period of time, indicating portions are worn out to disappear and be obscured such that it may not be possible to grip the bar at precise intervals. Accordingly, since it may not be possible to hold the barbell at equal intervals based on the center of the barbell, an error in which muscles of any one of a left side and a right side are more developed may occur and a disease such as scoliosis may be caused.

Also, in the conventional Smith machine, a bench located in the center thereof may be used. Here, since an indicating portion capable of indicating a position of the bench is not included, it may not be possible to locate the bench in the exact center of the Smith machine. Accordingly, also upon exercise lifting the barbell when the bench is not located in the exact center, the same problem as when the barbell is held at different left and right intervals may occur.

Technical Problem

The present invention is directed to providing an angle-adjustable and swingable Smith machine in which a frame configured to guide upward or downward movements of a barbell bar is allowed to swing such that exercise effects may vary according to swing angles.

The present invention is also directed to providing an angle-adjustable and swingable Smith machine for leveling barbells with a bottom surface.

The present invention is also directed to providing an angle-adjustable and swingable Smith machine capable of centering barbells and locating benches in the exact center of the Smith machine.

Technical Solution

One aspect of the present invention provides an angle-adjustable and a swingable Smith machine including a frame portion which forms an exercise space, a swing portion disposed in the exercise space and connected to the frame portion, a guide portion integrally coupled to the swing portion to swing therewith, a rail portion installed at a top end of the frame portion and configured to guide a movement of the swing portion and to set or to fix an angle of the swing portion, an angle adjusting portion for adjusting the angle of the swing portion in connection with the rail portion, and a barbell portion coupled to the guide portion to move upward or downward.

The angle-adjustable and swingable Smith machine may include a sensor portion configured to sense a current barbell angle and a position and an operation panel for display.

Another aspect of the present invention provides an angle-adjustable and swingable Smith machine, in addition to one aspect, including a screw motor and a screw bar connected to bottom ends of the frame portion and the swing portion to adjust the angle of the swing portion and a barbell portion coupled to the guide portion to be movable upward or downward.

Advantageous Effects

According to embodiments of the present invention, one of two types of manually or automatically operated apparatuses using electricity may be selected, a variety of angles corresponding to desired muscle areas may be set, a barbell may be stably moved upward or downward according to a set path, and a set angle or a free angle may be adjusted such that the same effect as that of naturally doing exercise using a conventional barbell may be obtained.

According to embodiments of the present invention, since a level may be adjusted according to conditions of a bottom surface on which a Smith machine is disposed, a barbell may be located to be leveled with the bottom surface such that precise left and right symmetrical exercises may be performed without a leaning phenomenon.

According to embodiments of the present invention, when a barbell of a Smith machine is held, the barbell may be gripped at precise left and right intervals due to an indicating function.

According to embodiments of the present invention, since a display function and a fixing device capable of locating a bench in the exact center of a Smith machine are included, when breast exercises such as bench presses are performed, precise left and right symmetrical exercises may be performed without the leaning phenomenon.

BRIEF DESCRIPTION OF DRAWINGS

FIG. 1 is a side perspective view of an angle-adjustable and swingable Smith machine according to a first embodiment of the present invention.

FIG. 2 is a rear perspective view of the angle-adjustable and swingable Smith machine according to the first embodiment of the present invention.

FIG. 3 is an enlarged exploded perspective view illustrating an angle adjusting portion according to the first embodiment of the present invention.

FIG. 4 is an exploded perspective view illustrating a state in which an angle of a swing portion has been adjusted in the Smith machine of FIG. 3.

FIG. 5 is an exploded perspective view illustrating a state in which the swing portion operates within a range of a slot in the Smith machine of FIG. 3.

FIG. 6 is an enlarged view illustrating a barbell portion in the Smith machine according to the first embodiment of the present invention.

FIG. 7 is an operation state of FIG. 6.

FIG. 8 is a schematic diagram illustrating a structure of a barbell weight and a wire in the Smith machine according to the first embodiment of the present invention.

FIGS. 9-11 are schematic diagrams illustrating an operation of the angle adjusting portion in the Smith machine according to the first embodiment of the present invention.

FIG. 12 is a side view of the Smith machine according to the first embodiment of the present invention.

FIG. 13 is a side perspective view of an angle-adjustable and swingable Smith machine according to a second embodiment of the present invention.

FIG. 14 is a side view of the angle-adjustable and swingable Smith machine according to the second embodiment of the present invention.

FIG. 15 is a side view illustrating a state in which an angle of a swing portion has been adjusted in the Smith machine of FIG. 14.

FIG. 16 is a detailed side view illustrating a handle portion and a screw motor of the Smith machine of FIG. 14.

| | |
|---|---|
| 10: Frame Portion | 20: Swing Portion |
| 30: Rail Portion | 40: Barbell Portion |
| 50: Guide Portion | 60: Angle Adjusting Portion |
| 70: Swing Compensator | 80: Bench |
| 90: Barbell Weight | |

MODE FOR INVENTION

Hereinafter, embodiments of the present invention will be described in detail with reference to the attached drawings to be easily performable by one of ordinary skill in the art. However, the present invention may be embodied in a variety of different shapes and is not limited to the embodiments disclosed herein. Throughout the specification, like reference numerals refer to like elements.

Also, when a pair of components are described, although only one component thereof is generally described with one reference numeral, it will be easily understood by one of ordinary skill in the art that the other component thereof has the same configuration and performs the same operation.

Also, in describing angle-adjustable and swingable Smith machines according to a variety of embodiments of the present invention, for convenience of understanding, a part through which a user enters and exits is referred to as a front and another part opposite thereto is referred to as a rear.

An angle-adjustable and swingable Smith machine according to a first embodiment of the present invention will be described with reference to the attached drawings. As shown in FIGS. 1 and 2, the Smith machine according to the first embodiment of the present invention is a Smith machine used in a manual mode.

Referring to FIGS. 1 and 2, the angle-adjustable and swingable Smith machine (hereinafter, the Smith machine) 1 according to the first embodiment of the present invention includes a frame portion 10 which forms an exercise space, a swing portion 20 disposed in the exercise space and connected to the frame portion, a guide portion 50 integrally connected to the swing portion 20 to perform a swing operation therewith, a rail portion 30 installed at a top end of the frame portion 10 and configured to guide a movement of the swing portion 20 and set or fix an angle of the swing portion 20, an angle adjusting portion 60 for adjusting the angle of the swing portion 20 in connection with the rail portion 30, and a barbell portion 40 coupled to the guide portion 50 to move upward or downward.

The frame portion 10 forms a frame having a rectangular-parallelepiped shape and a support body for supporting and fixing a variety of components of the present invention. The frame portion 10 is described as the frame having the rectangular-parallelepiped shape in the present invention but may have a variety of modifications in shape thereof.

The swing portion 20 includes a pair of vertical bars 21*a* and 21*b* arranged at an interval in the exercise space in the frame portion 10 and a horizontal bar 23 configured to connect the pair of vertical bars from above. A holding member 25 in which a plurality of concaved portions for holding a held piece of a barbell are installed on one side surface of each of the vertical bars 21*a* and 21*b*. The vertical bars and the horizontal bar are integrally coupled to pivot with the swing operation of the swing portion 20.

A top end of the swing portion 20 is pivotably spaced apart from the frame portion 10, and a bottom end thereof is pivotably coupled to a fixing bearing portion 11 installed on one side of the frame portion 10. Accordingly, the swing portion 20 may pivot on the fixing bearing portion 11 as the center of a hinge shaft.

The guide portion 50 includes a pair of guide bars 51*a* and 51*b* installed to be spaced apart from and be parallel to the vertical bars 21*a* and 21*b* of the swing portion 20. Sliding members 53*a* and 53*b* are slidably installed on the pair of guide bars 51*a* and 51*b* and vertically move upward or downward along the guide bars.

Here, the barbell portion 40 is located between the guide bars 51*a* and 51*b* and the vertical bars 21*a* and 21*b*.

The barbell portion 40 is coupled to the sliding members 53*a* and 53*b* such that the sliding members 53*a* and 53*b* move upward or downward along the guide bars 51*a* and 51*b* according to upward or downward movement of the barbell portion 40.

The rail portion 30 has an arc-shaped thin plate structure which connects a front and a rear of a center at the top end of the frame portion 10 and shares a central point of the fixing bearing portion 11. A plurality of fixing grooves 31 are formed at a side surface of the rail portion 30 to be used for pivoting the swing portion 20 by a set angle and fixing the swing portion 20 at a position.

Also, a long slot 33 is formed in a certain range including a central part of the rail portion 30 such that the swing portion 20 is freely pivotable within a certain range of angles, for example, −15 to 15 degrees.

Since the plurality of fixing grooves 31 are formed at the slot 33, the swing portion 20 may be fixed at a certain angle within the range of the slot 33 for freely pivoting the swing portion according to user's needs.

The fixing grooves 31 are installed to be spaced apart at certain intervals such that an angle may be changed whenever the swing portion 20 pivots and then may be fixed.

A supporting roller portion 27 is installed in a center of a top end of the horizontal bar 23 of the swing portion 20. A roller of the supporting roller portion 27 has a groove slightly wider than a thickness of the rail portion 30 to engage with a top end of the rail portion 30 to guide and support a pivoting movement of the swing portion 20.

As shown in FIGS. 3, 9, 10, and 11, the angle adjusting portion 60 is for adjusting the angle of the swing portion 20 in connection with the rail portion 30. The angle adjusting portion 60 includes a main adjustor 61 installed on one side of the vertical bar 21*a* to operate when a user adjusts an angle, a pivoting bar 63 to which the main adjustor 61 is connected and in which a bottom thereof hinge-coupled and a top thereof pivots, an operating rod 65 connected to a top end of the pivoting bar 63 and configured to extend to and installed at the rail portion 30, and an angle adjustor 67 installed at an end of the operating rod 65 and configured to operate along translation of the operating rod 65.

The main adjustor 61 has a structure to be gripped and adjusted by a user and includes a gripping portion 613 connected to the vertical bar 21*a* of the swing portion 20, a connecting plate 617 fixed to the pivoting bar 63, a handle 611 disposed in the gripping portion 613 and coupled to the connecting plate 617, and a stopper 615 configured to restrict an operation of the handle 611.

The gripping portion 613 is for locating a palm of the user and functions as a support. The connecting plate 617 functions as an adapter for connecting the handle 611 to the pivoting bar 63. The handle 611 is operated by pulling by the user's hand and has a structure capable of returning toward the swing portion 20 due to a restoring force of a spring (not shown) in a housing of the angle adjustor 67 when the user takes the hand off the handle 611.

Also, the stopper 615 is for restoring a movement of the handle 611 and allows the angle adjustor 67 to move only in the slot 33. A spring 619 for allowing the stopper 615 to return to an original position thereof is coupled to the stopper 615. That is, when the stopper 615 is pivoted counterclockwise viewed from the gripping portion 613, the movement of the handle 611 may be restricted. When the stopper 615 pivots clockwise due to the restoring force of the spring 619, the handle 611 may freely move.

A fixing hole 614 is formed in one side of the stopper 615, and a protruding pin 612 capable of being inserted into the fixing hole 614 is integrally formed at the handle 611. Accordingly, when the handle 611 is released while the stopper 615 has pivoted counterclockwise, the protruding pin 612 of the handle 611 is inserted into the fixing hole 614 of the stopper 615 such that the handle 611 is not movable any longer. In this state, when the handle is pulled again, the stopper 615 returns to the original position due to the spring 619 and the handle 611 freely moves.

The protruding pin 612 may have a shape with protrusions of two lengths. For example, as shown in FIGS. 13 and 16, a first protrusion 612*a* and a second protrusion 612*b* are provided, and the first protrusion 612*a* is used in a manual mode and the second protrusion 612*b* is used in an automatic mode. The first protrusion 612*a* and the second protrusion 612*b* are rotatably mounted and changeable in positions. The first protrusion 612*a* may have a protruding length smaller than that of the second protrusion 612*b*.

Also, there are included a stopper restricting rod 641 coupled to the swing portion 20 to restrict pivoting of the stopper 615 and configured to restrict or release the pivoting of the stopper 615, a horseshoe-shaped fixing piece 642 which includes a concave groove 643 formed on a top end thereof to vertically move the stopper restricting rod 641, a tensile spring 645 installed to allow the stopper restricting rod 641 to constantly have a force to move downward, and a restricting pin 618 formed to protrude from the stopper 615 toward the stopper restricting rod. Accordingly, when the swing portion 20 moves by the angle within the range of the slot 33 of the rail portion 30, since the stopper restricting rod 641 is located in the concave groove 643 of the horseshoe-shaped fixing piece 642, the stopper 615 has been moved downward and may freely pivot in this state. However, when the angle of the swing portion 20 deviates from the range of the slot 33 of the rail portion 30, the stopper restricting rod 641 pivots by the same angle as that of the swing portion 20 and deviates from the concave groove 643 of the horseshoe-shaped fixing piece 642 and is located higher to move upward. In this state, a restricting pin 618 of the stopper 615 is held by the stopper restricting rod 641 not to be pivotable.

The pivoting bar 63 is installed lengthwise at the vertical bar 21*a* of the swing portion 20 along a longitudinal direction thereof and may pivot laterally on a pivoting hinge shaft 623 located at a bottom end.

Also, the operating rod 65 has one side connected to the top end of the pivoting bar 63, and is installed to extend toward the rail portion 30 along the horizontal bar 23. The operating rod 65 may translate onto the horizontal bar 23 according to pivoting of the top end of the pivoting bar 63.

The angle adjustor 67 is integrally installed on the other side of the operating rod 65. Here, the angle adjustor 67 may be inserted into the fixing groove 31 formed at the rail portion 30 or may freely move along the slot 33.

The angle adjustor 67 includes a body 271, a fixing protrusion 273 integrally formed at a front end of the body 271, and a free protrusion 275 integrally formed at a front end of the fixing protrusion 273. Here, a diameter of the free protrusion 275 may be smaller than a diameter of the fixing protrusion 273 and may have a size capable of freely moving on the slot 33. Also, the diameter of the fixing protrusion 273 may have a size capable of being inserted into the fixing groove 31.

Also, although not shown in the drawings, the angle adjustor 67 includes an adjusting pin and a spring in the body 272 to return to the original position.

The vertical bars 21*a* and 21*b* of the swing portion 20 are installed above one side of a rotating shaft 13 of the fixing bearing portion 11, and a swing portion compensating member 70 is installed below the other side thereof. The swing portion compensating member 70 balances zero by compensating the entire weight of the swing portion 20 and includes a compensating frame 73 coupled to the rotating shaft 13 and a plurality of swing weights 75 coupled to the compensating frame 73. Here, the compensating frame 73 may have an L-shaped structure bent in an opposite direction in which the barbell portion 40 is located, that is, toward the rear of the Smith machine 1. A shape of the compensating frame 73 is for efficiently compensating a weight in a small space by locating the swing weights 75 in a direction opposite to a rotational direction of the swing portion 20. The number or weights of the plurality of swing weights 75 may vary according to the entire weight of the swing portion 20.

As shown in FIG. 6, the barbell portion 40 is installed throughout left and right sides of the frame portion 10 and has a bar shape which extends lengthwise. The barbell portion 40 includes a barbell 41 having a long bar shape, a held piece 43 fixedly installed on both sides of the barbell 41 and held by and located at a concave portion 253 of the holding member 25, and a barbell connecting plate 45 for coupling the barbell 41 to the sliding members 53*a* and 53*b* of the guide portion 50.

Accordingly, when a weight (not shown) is attached to the barbell 41 and then the barbell 41 moves upward or downward, the sliding members 53*a* and 53*b* may vertically slide along the guide bars 51*a* and 51*b* according to the movement of the barbell 41. Through the operation, the user may move along a uniform path.

Also, a groove may be formed in both left and right sides of a central line of the barbell 41 to indicate positions for being gripped by hands and a circular indicating ring 47 may be mounted on the groove. The indicating ring 47 may be everlastingly colored without being decolored or discolored. Through this, users may precisely and easily determine a distance between the left and right sides of the barbell 41.

As shown in FIGS. 6 and 7, a barbell position sensing device 420 for sensing a lowermost position of the barbell 41 is installed at a bottom end of the vertical bar 21*a*. In the barbell position sensing device 420, a barbell contact piece 423 formed to protrude is pivotably mounted on the vertical bar to sense a contact when the barbell 41 is positioned at a lowermost point, and a position adjustor 425 is pivotably mounted on the end of the barbell contact piece 423. The position adjustor 425 passes through a bottom of the vertical bar and is inserted into a hole 638 formed at a bottom end of the pivoting bar 63 or released therefrom such that pivoting of the pivoting bar 63 may be restricted or be free. The position adjustor 425 has a structure in which an adjusting pin is inserted into a housing. A spring (not shown) is installed at the pin such that the position adjustor 425 is positioned to be constantly inserted into the hole 638 of the pivoting bar 63.

As a position of the barbell portion 40 is higher on the basis of a center of the fixing bearing portion 11, more force is necessary for adjusting the angle of the swing portion 20. On the other hand, as the position of the barbell portion 40 is lower, less force is necessary for adjusting the angle of the swing portion 20. Accordingly, the barbell portion 40 should be located at a lowermost end to adjust the angle with less force. Accordingly, when the barbell portion 40 is located at a top end, the barbell position sensing device 420 restricts the pivoting bar 63 not to move and the barbell portion 40 moves down to a bottom end to operate the barbell position sensing device 420 such that pivoting bar 63 may move.

In operation of the barbell position sensing device 420, as shown in FIG. 7, when the barbell 41 moves down to the lowermost end and pushes the barbell contact piece 423, a protruding portion of the barbell contact piece 423 pivots downward and then the adjusting pin of the position adjustor 425 deviates frontward such that the pivoting bar 63 may pivot.

On the other hand, as shown in FIG. 6, when the barbell 41 is located at the top end and does not come into contact with the barbell contact piece 423, the barbell contact piece 423 returns to an original position due to a restoring force of a spring device (not shown) and the adjusting pin of the position adjustor 425 connected thereto moves backward to be inserted into the hole 638 of the pivoting bar 63 such that a movement of the pivoting bar 63 is restricted.

As shown in FIG. 8, a barbell weight 90 is connected to the barbell portion 40 through a wire 91 to compensate a weight of the barbell portion 40. The wire 91 may disperse force through a plurality of upper pulleys or lower pulleys. Here, it is very important to install an adjusting pulley 95 to be adjacent to the fixing bearing portion 11 and to set a precise position of the adjusting pulley 95. That is, the adjusting pulley 95 may be disposed so that a bent point P between part A and part B of the wire 91, which passes through the adjusting pulley 95, coincides with a central point of the rotating shaft 13 of the fixing bearing portion 11.

In this structure, even when the user adjusts the angle of the swing portion 20, the weight 90 does not change in position. Also, an effect of adjusting the angle with less force like a lowermost end position sensing function of the barbell 41 is provided.

Also, a level 155 is installed below a center of the frame portion 10 such that it is possible to check whether the Smith machine is leveled with a bottom surface. That is, when the Smith machine is not leveled, it is possible to level the Smith machine by adjusting levelizers 150 installed at four corners of the frame portion 10. The levelizer 150 may have a structure for adjusting a height by spiral rotation. The level of the barbell 41 is finally adjustable through the level adjustment such that precise bilateral-symmetrical movement may be performed without a leaning phenomenon.

Also, in the present invention, it is important to locate a bench 80 at which the user is located in the exact center of the Smith machine 1. Accordingly, a display device 85 is provided in an exact central portion of the rear of the frame portion 10 such that a front end of the bench 80 may be mounted on the display device. It is obvious to those skilled in the art that the display device 85 may be any component having a structure capable of displaying the exact center and may be variously changed.

Hereinafter, an operation of the angle-adjustable and swingable Smith machines according to the first embodiment of the present invention will be described in detail.

Referring to FIGS. 3 and 9, the swing portion 20 of the Smith machine 1 forms an angle of 90 degrees when the user lies on the bench 80. Here, the pivoting bar 63 is located to coincide with the vertical bar 21*a* in parallel, and the fixing protrusion 273 of the angle adjustor 67 coupled to the operating rod 65 is completely inserted into the fixing groove 31 to be fixedly located. In this state, the user performs muscular movement by vertically moving the barbell 41 upward.

In this state, when the user wants to exercise by adjusting the angle of the swing portion 20, as shown in FIG. 4, the exercise may be performed by variously adjusting and then fixing the angle of the swing portion 20.

Referring to FIGS. 4 and 10, to adjust the angle, first, when the user locates the barbell portion 40 at the lowermost end and pulls the handle 611 of the main adjustor 61 with a hand, the top end of the pivoting bar 63 pivots on the pivoting hinge shaft 623 by a certain angle θ1. Then, the operating rod 65 connected to the pivoting bar 63 moves and the angle adjustor 67 coupled thereto deviates from the fixing groove 31 of the rail portion 30. In this state, when the user pivots the swing portion 20 to locate the swing portion 20 at a desired position and then takes the hand off the handle 611, the handle 611 returns to the original position and accordingly the pivoting bar 63 also returns to the original position. As a result, as the operating rod 65 moves, the fixing protrusion 273 of the angle adjustor 67 is inserted into another fixing groove 31 such that the swing portion 20 is fixed at a certain angle.

The above-described angle adjustment of the swing portion 20 may be performed while the angle adjustor 67 is inserted into the fixing grooves 31 formed at the rail portion 30 according to a selection of the user.

Also, the user may exercise while the swing portion 20 is fixed. On the other hand, the user may exercise while the swing portion is freely movable within a certain range. That is, the swing portion 20 is freely movable according to an exercise path when the user moves the barbell 41 upward or downward.

Referring to FIGS. 5 and 11, when the swing portion 20 is located within the range of the slot 33 and then the user pulls the handle 611 of the main adjustor 61 with the hand and rotates the stopper 615 counterclockwise when viewed from the gripping portion 613, the handle 611 is obstructed by the stopper 615 and does not return to the original position any longer. Then, the top end of the pivoting bar pivots on the pivoting hinge shaft 623 by a certain angle θ2. Then, the operating rod 65 connected to the pivoting bar 63 moves by only a small range and the fixing protrusion 273 of the angle adjustor 67 connected thereto deviates from the fixing groove 31 of the rail portion 30. However, the free protrusion 275 of the angle adjustor 67 is located in the slot 33 of the rail portion 30 and does not deviate thus longer.

In this state, when the user moves the barbell 41 upward or downward, the swing portion 20 is freely movable only within the range of the slot 33.

Here, when the user wants to fix the swing portion 20 at a certain angle again, the user pulls the handle 611 of the main adjustor 61. Then, the stopper 615 rotates clockwise and returns to the original position due to the restoring force of the spring 619 connected thereto and releases the handle 611. Then, the handle 611 returns to the original position, and accordingly, the pivoting bar 63 also returns to the original position. As a result, as the operating rod 65 moves, the fixing protrusion 273 of the angle adjustor 67 is inserted into another fixing groove 31 such that the swing portion 20 is fixed at a certain angle.

Hereinafter, an angle-adjustable and swingable Smith machine according to a second embodiment of the present invention will be described with reference to the attached drawings. As shown in FIGS. 13 and 15, the Smith machine according to the second embodiment of the present invention is a Smith machine used in an automatic mode generally using electricity.

The Smith machine according to the second embodiment of the present invention is electrically embodied and significant components and operations thereof are similar or equal to the Smith machine according to the first embodiment of the present invention. Accordingly, like reference numerals refer to like elements and a detailed description on the like component will be omitted.

A Smith machine 5 according to the second embodiment of the present invention, basically, pivots the swing portion 20 using a screw motor 400. The screw motor 400 is mounted on the frame portion 10, and a screw bar 401 connected to the screw motor 400 is connected to the swing portion 20. The screw bar 401 of the screw motor 400 linearly moves. In more detail, the screw bar 401 is coupled to the compensating frame 73 of the swing portion compensating member 70. Accordingly, a length of the screw bar 401 is changed by an operation of the screw motor 400 such that the swing portion compensating member 70 pivots. According to rotation of the rotating shaft 13 connected thereto, the swing portion 20 pivots on the rail portion 30 forward or backward.

A connecting device capable of selectively connecting or separating the screw motor 400 and the screw bar 401 to or from a bottom end of the swing portion may be further included.

Also, a height sensor portion 300 is perpendicularly installed at the swing portion 20 in a longitudinal direction to sense a height of the barbell. Accordingly, it is sensed that the height of the barbell 41 reaches a lowermost point, and the screw motor 400 is operated.

The angle sensor portion 200 is installable on one side of the rail portion 30, and a plurality of sensors are attached to the angle sensor portion 200 to sense the angle of the swing portion 20.

Since an electrical angle adjustor 670 may be additionally installed in a center of a top end of the horizontal bar 23 to be located to be adjacent to the rail portion 30, the electrical angle adjustor 670 is inserted into the fixing groove 31 of the rail portion 30 such that the swing portion 20 may be fixed. The electrical angle adjustor 670 may be a solenoid valve.

The electrical angle adjustor 670 and the screw motor 400 operate in connection with each other at the same time due to an operation panel 500.

The above-described electric Smith machine may be driven by the operation panel 500. The user may adjust the angle of the swing portion 20 through the operation panel 500.

In the Smith machines according to the first and second embodiments of the present invention, current height and angle of the barbell may be displayed on the operation panel in either the manual mode or the automatic mode.

In addition, as shown in FIG. 16, when the manual mode changes to the automatic mode, the handle for adjusting the angle is pulled toward a user's body to fix the second protrusion 612*b* of the handle 611 to the fixing hole 614 of the stopper 615 such that the fixing protrusion and the free protrusion of the angle adjustor do not come into contact with the rail portion. A connecting device 700 is mounted to easily connect or separate the screw motor to or from the bottom end of the swing portion and a sensor or switch is provided in the connecting device 700 such that a connection or separation state may be sensed. Accordingly, in the automatic mode, the screw motor and the electrical angle adjustor may be automatically operated through the operation panel 500.

When the automatic mode changes to the manual mode, the connecting device 700 is released and the handle 611 is further pulled toward the user's body such that the second protrusion 612*b* of the handle 611 is separated from the fixing hole 614 of the stopper 615 and manual operation is available.

Also, in the Smith machine according to the second embodiment of the present invention, as shown in FIG. 8, an autonomous generator 690 is installed at any one selected from the plurality of pulleys which support the wire 91 which connects the barbell weight 90 such that electricity may be produced in normal rotation or reverse rotation of the pulley. Also, a charger capable of applying external power may be mounted on the bottom of the frame portion.

The above-mentioned produced electricity may be stored in a charged battery and may be used for operating the Smith machine. When the charged battery is exhausted, an external power source may be connected and used.

Although the exemplary embodiments of the present invention have been described above in detail, the scope of the present invention is not limited thereto and includes a variety of changes and modifications made by those skilled in the art using the basic concept of the present invention defined by the following claims.

The invention claimed is:

1. An angle-adjustable and swingable Smith machine comprising:

a frame portion which forms an exercise space;

a swing portion disposed in the exercise space and connected to the frame portion;

a guide portion integrally coupled to the swing portion to swing therewith;

a rail portion installed at a top end of the frame portion to connect a front and a rear of the top end of the frame portion and configured to guide a movement of the swing portion and to have a plurality of fixing grooves formed on at least one side of the rail portion to set or to fix an angle of the swing portion;

an angle adjusting portion for adjusting the angle of the swing portion in connection with the rail portion; and a barbell portion coupled to the guide portion to move upward or downward, wherein the swing portion includes first and second vertical bars arranged at an interval in the exercise space in the frame portion, a horizontal bar configured to connect the first and second vertical bars from above, a holding member installed on one side of each of the first and second vertical bars and including a plurality of concave portions formed thereon, and, a supporting roller portion installed in a top end of the horizontal bar to engage with a top end of the rail portion and configured to move along the top end of the rail portion.

2. The angle-adjustable and swingable Smith machine of claim 1, wherein a top end of the swing portion is pivotably installed to be spaced apart from the frame portion, and a bottom end thereof is pivotably coupled to a fixing bearing portion installed on one side of the frame portion, the Smith machine further comprising a swing portion compensating member installed below to a rotating shaft of the fixing bearing portion, wherein the swing portion compensating member comprises a compensating frame coupled to the rotating shaft and a plurality of swing weights coupled to the compensating frame, and wherein the compensating frame has an L-shaped structure which is bent in an opposite direction in which the barbell portion is located, that is, bent toward a rear of the Smith machine.

3. The angle-adjustable and swingable Smith machine of claim 1, wherein the rail portion has an arc-shaped thin plate structure which shares a central point of a fixing bearing portion, a long slot is formed within a certain range based on a central portion of the rail portion, and a plurality of fixing grooves are formed on the slot, and wherein a roller of the supporting roller portion includes a groove formed thereon slightly wider than a thickness of the rail portion to engage with the top end of the rail portion.

4. The angle-adjustable and swingable Smith machine of claim 2, wherein the angle adjusting portion comprises a main adjustor installed on one side of the first vertical bar to operate when a user adjusts an angle, a pivoting bar to which the main adjustor is connected and in which a bottom thereof is hinge-coupled and a top thereof pivots, an operating rod connected to a top end of the pivoting bar and installed while extending toward the rail portion, and an angle adjustor installed on an end of the operating rod and configured to operate according to a translation movement of the operating rod, wherein the angle adjustor comprises a body, a fixing protrusion integrally formed at a front end of the body, and a free protrusion integrally formed at a front end of the fixing protrusion, and wherein a diameter of the free protrusion is smaller than a diameter of the fixing protrusion, and the diameter of the fixing protrusion has a size capable of being inserted into the fixing grooves.

5. The angle-adjustable and swingable Smith machine of claim 4, wherein the main adjustor comprises:

a gripping portion connected to the first vertical bar of the swing portion;

a connecting plate fixed to the pivoting bar;

a handle disposed in the gripping portion and coupled to the connecting plate;

a stopper for restricting an operation of the handle; and a spring coupled to the stopper for allowing the stopper to return to an original position.

6. The angle-adjustable and swingable Smith machine of claim 2, wherein the barbell portion comprises a long bar-shaped barbell, a held piece fixedly installed on both sides of the barbell and held by the concave portion of the holding member to be located thereon, and a barbell connecting plate for coupling the barbell to the guide portion, and wherein a circular indicating ring is mounted on the barbell to indicate positions for gripping with hands on left and right sides based on a central line.

7. The angle-adjustable and swingable Smith machine of claim 6, further comprising a barbell position sensing device installed at a bottom end of the first vertical bar to sense a position of a lowermost point of the barbell, wherein the barbell position sensing device comprises:

a barbell contact piece which protrudes to sense a contact when the barbell is located at the lowermost point and is pivotably mounted on the first vertical bar; and a position adjustor pivotably mounted on the other end of the barbell contact piece and capable of passing through the first vertical bar and being inserted into or separated from a hole formed at a bottom end of a pivoting bar.

8. The angle-adjustable and swingable Smith machine of claim 6, further comprising a barbell weight connected to the barbell portion through a wire to compensate for a weight of the barbell portion, wherein an adjusting pulley is installed to be adjacent to the fixing bearing portion and is disposed so that a bent point P between part A and part B of the wire, which passes through the adjusting pulley, coincides with a central point of a rotating shaft of the fixing bearing portion.

9. The angle-adjustable and swingable Smith machine of claim 6, wherein a level is installed on one side of the frame portion to level the barbell, and wherein levelizers are installed at four corners of the frame portion.

10. The angle-adjustable and swingable Smith machine of claim 1, further comprising a display device installed in an exact center portion of a rear of the frame portion to locate a bench in the exact center of the Smith machine.

11. The angle-adjustable and swingable Smith machine of claim 5, wherein a fixing hole is formed in one side of the stopper, and a protruding pin capable of being inserted into the fixing hole is integrally formed at the handle as a whole, and wherein the protruding pin comprises a first protrusion and a second protrusion, which have different lengths and are rotatably mounted to change in positions, the Smith machine further comprising a stopper restricting rod coupled to the swing portion and configured to restrict or release pivoting of the stopper, a horseshoe-shaped fixing piece including a concave groove on a top end thereof to move the stopper restricting rod upward or downward, a tensile spring installed to allow the stopper restricting rod to constantly have a force to move downward, and a protruding pin formed to protrude from the stopper toward the stopper restricting rod.

12. The angle-adjustable and swingable Smith machine according to claim 1, further comprising a screw motor and a screw bar connected to bottom ends of the frame portion and the swing portion to electrically adjust an angle of the swing portion, and a connecting device capable of selectively connecting or separating the screw motor and the screw bar to or from the bottom end of the swing portion, wherein the connecting device comprises a sensor or a switch therein to sense a connection or a separation of the screw motor and the bottom end of the swing portion.

13. The angle-adjustable and swingable Smith machine of claim 12, wherein an electrical angle adjustor is additionally installed to be adjacent to the rail portion, and wherein an angle sensor portion is installed at the top end of the rail portion, and wherein a height sensor portion is perpendicularly installed at the swing portion in a longitudinal direction, the Smith machine comprising an operation panel on a top end of a left side or a right side of a front surface of a frame and configured to display a current height and an angle of the barbell.

14. The angle-adjustable and swingable Smith machine of claim 8, wherein an autonomous generator is installed at any one selected from the pulleys which support the wire, and a charger capable of applying external power is mounted below the frame.

* * * * *